US010388448B2

(12) United States Patent
Nagai et al.

(10) Patent No.: US 10,388,448 B2
(45) Date of Patent: Aug. 20, 2019

(54) MULTILAYER COIL COMPONENT

(71) Applicant: TDK CORPORATION, Tokyo (JP)

(72) Inventors: Yuusuke Nagai, Tokyo (JP); Takashi Suzuki, Tokyo (JP); Kouichi Kakuda, Tokyo (JP); Kunihiko Kawasaki, Tokyo (JP); Shinichi Kondo, Tokyo (JP); Yuya Ishima, Tokyo (JP); Shinichi Sato, Tokyo (JP); Masaki Takahashi, Tokyo (JP); Takashi Endo, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 15/617,401

(22) Filed: Jun. 8, 2017

(65) Prior Publication Data

US 2017/0372829 A1 Dec. 28, 2017

(30) Foreign Application Priority Data

Jun. 28, 2016 (JP) ..... 2016-127779

(51) Int. Cl.

| | |
|---|---|
| ***H01F 5/00*** | (2006.01) |
| ***H01F 27/255*** | (2006.01) |
| ***H01F 17/00*** | (2006.01) |

(52) U.S. Cl.

CPC ..... *H01F 27/255* (2013.01); *H01F 5/00* (2013.01); *H01F 17/0013* (2013.01); *H01F 17/0033* (2013.01)

(58) Field of Classification Search

CPC ..... H01F 5/00; H01F 27/00–36
USPC ..... 336/65, 83, 200, 212, 232–234
See application file for complete search history.

(56) References Cited

U.S. PATENT DOCUMENTS

| | | | |
|---|---|---|---|
| 2013/0038419 | A1 | 2/2013 | Kobayashi et al. |
| 2014/0097927 | A1 | 4/2014 | Yamamoto et al. |
| 2015/0155084 | A1 | 6/2015 | Kim et al. |
| 2017/0025217 | A1 | 1/2017 | Yamamoto et al. |

FOREIGN PATENT DOCUMENTS

| | | | |
|---|---|---|---|
| CN | 102930947 | A | 2/2013 |
| CN | 103597558 | A | 2/2014 |
| JP | 2694757 | B2 | 12/1997 |
| JP | 5048156 | B1 | 10/2012 |
| KR | 20150062836 | A | 6/2015 |
| TW | 201310474 | A | 3/2013 |

*Primary Examiner* — Tuyen T Nguyen
(74) *Attorney, Agent, or Firm* — Oliff PLC

(57) ABSTRACT

A multilayer coil component includes an element body including soft magnetic metal powders and a coil disposed in the element body. The coil includes a plurality of internal conductors electrically connected to each other. The plurality of internal conductors are separated from each other in a first direction and are adjacent to each other in the first direction. An average particle diameter of the soft magnetic metal powders located at an inner side of the coil when viewing from the first direction is larger than an average particle diameter of the soft magnetic metal powders located between the internal conductors adjacent to each other in the first direction.

3 Claims, 7 Drawing Sheets

MULTILAYER COIL COMPONENT

TECHNICAL FIELD

The present invention relates to a multilayer coil component.

BACKGROUND

Japanese Patent No. 5048156 discloses a multilayer coil component. The multilayer coil component includes an element body that includes soft magnetic metal powders and a coil that is disposed in the element body. The coil includes a plurality of internal conductors that are electrically connected to each other. The plurality of internal conductors are separated from each other in a first direction and are adjacent to each other in the first direction.

SUMMARY

Permeability of the element body is low when particle diameters of the soft magnetic metal powders are small. In the multilayer coil component described in Japanese Patent No. 5048156, because the soft magnetic metal powders having the small particle diameters are located over the whole of magnetic material layers located between the internal conductors adjacent to each other, permeability of the entire element body is low. When the permeability is low, for example, it is necessary to increase the number of winding of the coil in order to increase an inductance value. If the number of winding of the coil increases, a resistance component of the coil increases. In order to decrease the resistance component of the coil, it is necessary to increase the permeability of the element body.

As a relation between the permeability and the resistance component, when the permeability is low, the resistance component decreases at a high frequency side. Therefore, if the permeability of the element body is increased, it is difficult to reduce loss at the high frequency side.

An object of the present invention is to provide a multilayer coil component in which loss at a high frequency side is reduced, even when permeability of an element body is increased.

A multilayer coil component according to an aspect of the present invention includes an element body including soft magnetic metal powders and a coil disposed in the element body. The coil includes a plurality of internal conductors that are electrically connected to each other. The plurality of internal conductors are separated from each other in a first direction and are adjacent to each other in the first direction. An average particle diameter of the soft magnetic metal powders located at an inner side of the coil when viewing from the first direction is larger than an average particle diameter of the soft magnetic metal powders located between the internal conductors adjacent to each other in the first direction.

In the multilayer coil component according to the aspect, the soft magnetic metal powders having the small average particle diameter are located between the internal conductors adjacent to each other in the first direction and the soft magnetic metal powders having the large average particle diameter are located at the inner side of the coil when viewing from the first direction. Therefore, in the multilayer coil component according to the aspect, permeability of the entire element body is high as compared with a multilayer coil component in which the soft magnetic metal powders having the small average particle diameter are located over the whole of magnetic material layers located between the internal conductors adjacent to each other. Because the average particle diameter of the soft magnetic metal powders located between the internal conductors adjacent to each other in the first direction is small, permeability between the internal conductors is low. Therefore, from a relation in which a resistance component at a high frequency side decreases when the permeability is low, an action to reduce loss at the high frequency side is provided between the internal conductors adjacent to each other in the first direction. At the high frequency side, a magnetic path is formed around the internal conductors, so that the action between the internal conductors adjacent to each other in the first direction is effectively provided. As a result, in the multilayer coil component according to the aspect, even when the permeability of the element body is increased, the loss at the high frequency side is reduced.

In the multilayer coil component according to the aspect, an average particle diameter of the soft magnetic metal powders located at an outer side of the coil when viewing from the first direction may be larger than the average particle diameter of the soft magnetic metal powders located between the internal conductors adjacent to each other in the first direction. In which case, in addition to the average particle diameter of the soft magnetic metal powders located at the inner side of the coil when viewing from the first direction, the average particle diameter of the soft magnetic metal powders located at the outer side of the coil when viewing from the first direction is large. Therefore, the permeability of the entire element body is further increased.

In the multilayer coil component according to the aspect, a maximum particle diameter of the soft magnetic metal powders located between the internal conductors adjacent to each other in the first direction may be smaller than a distance between the internal conductors adjacent to each other in the first direction. In which case, because the internal conductors adjacent to each other in the first direction are rarely connected electrically by the soft magnetic metal powders located between the internal conductors, short-circuiting of the internal conductors is suppressed.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION

Figure 1:
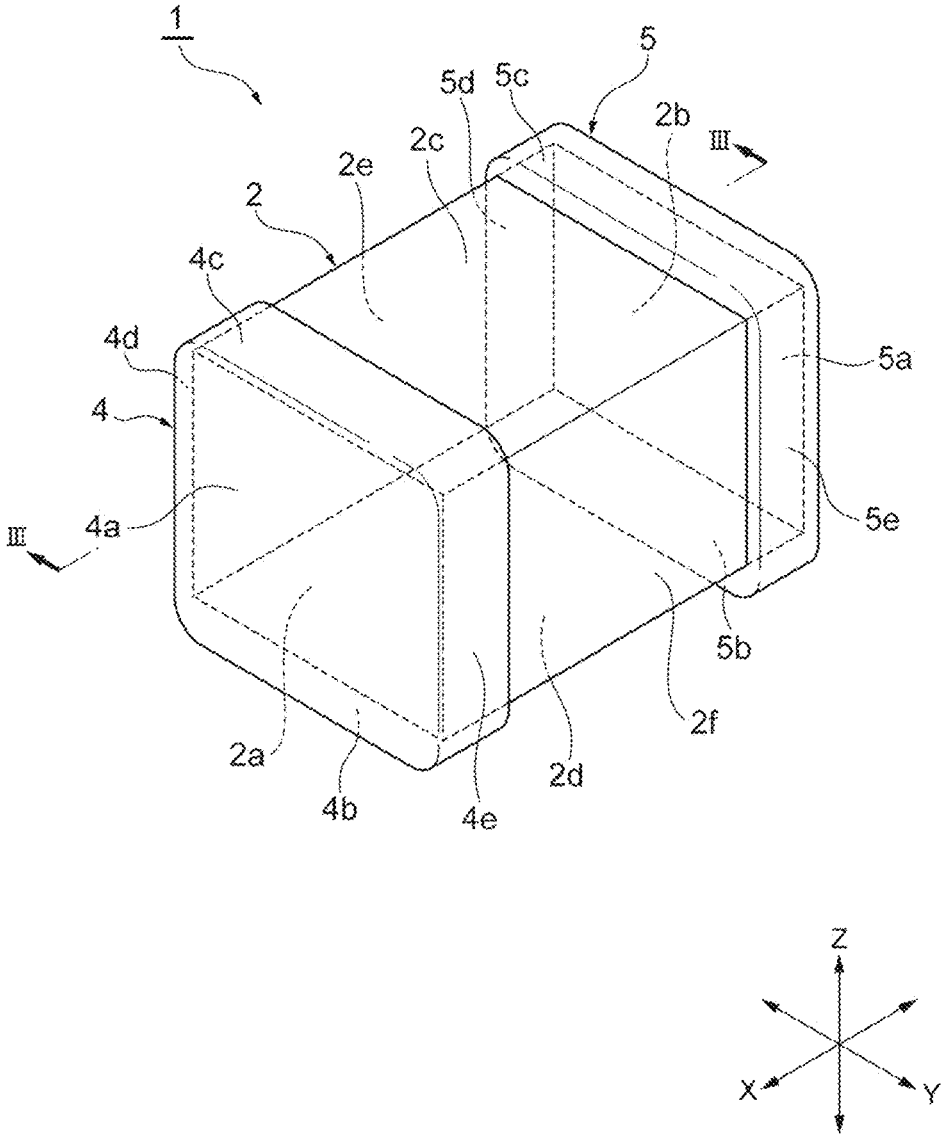
FIG. 1 is a perspective view illustrating a multilayer coil component according to a first embodiment.

Hereinafter, embodiments of the present invention will be described in detail with reference to the accompanying drawings. In the following description, the same elements or elements having the same functions are denoted with the same reference numerals and overlapped explanation is omitted.

First Embodiment

Figure 2:
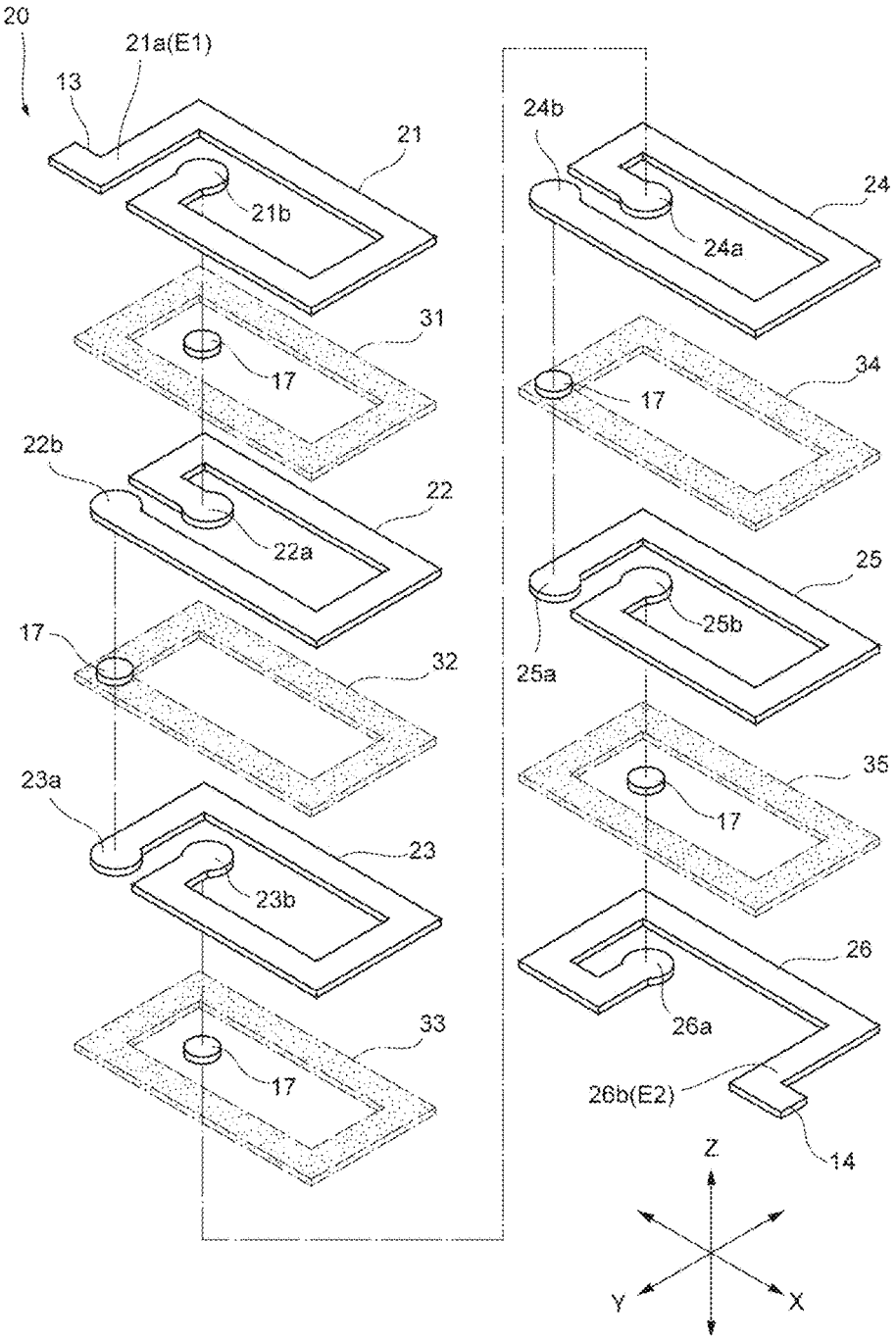
FIG. 2 is an exploded perspective view of the multilayer coil component illustrated in FIG. 1.
Figure 3:
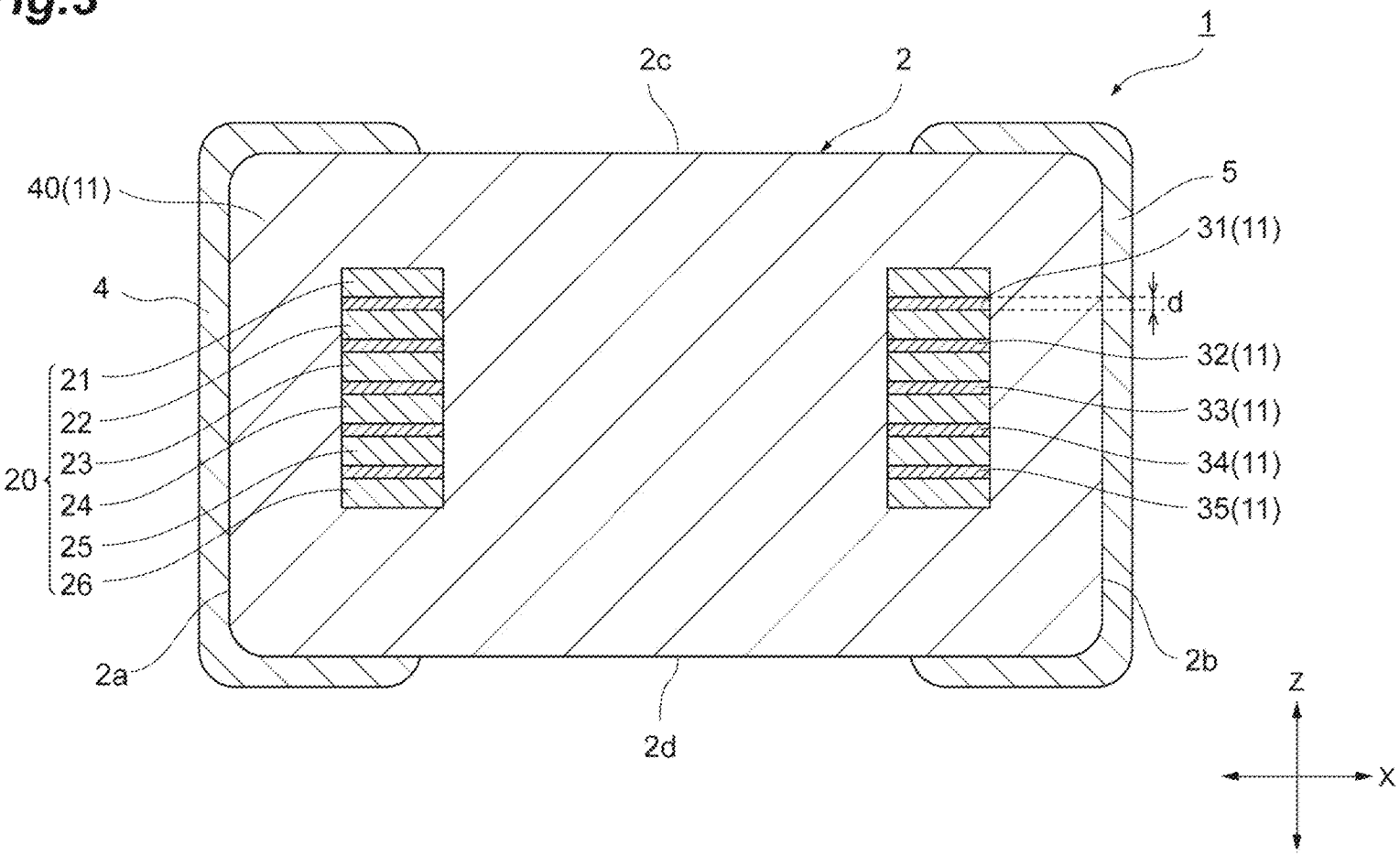
FIG. 3 is a cross-sectional view of the multilayer coil component taken along line III-III of FIG. 1.

A configuration of a multilayer coil component according to a first embodiment will be described with reference to FIGS. 1 to 3. FIG. 1 is a perspective view illustrating the multilayer coil component according to the first embodiment. FIG. 2 is an exploded perspective view of the multilayer coil component illustrated in FIG. 1. FIG. 3 is a cross-sectional view of the multilayer coil component taken along the line III-III of FIG. 1. In the exploded perspective view of FIG. 2, a plurality of coil conductors 21 to 26 included in an element body are shown by solid lines, low-permeability portions 31 to 35 located between the coil conductors 21 to 26 are shown by dashed-dotted lines, and illustration of other configuration is omitted.

As illustrated in FIGS. 1 to 3, a multilayer coil component 1 includes an element body 2, a pair of external electrodes 4 and 5, a coil 20, and connection conductors 13 and 14. The pair of external electrodes 4 and 5 is disposed on both ends of the element body 2. The coil 20 is disposed in the element body 2. The connection conductors 13 and 14 are disposed in the element body 2.

The element body 2 has a rectangular parallelepiped shape. The rectangular parallelepiped shape includes a shape of a rectangular parallelepiped in which a corner portion and a ridge portion are chamfered and a shape of a rectangular parallelepiped in which a corner portion and a ridge portion are rounded. The element body 2 has a pair of end faces 2*a* and 2*b* opposing each other and four lateral surfaces 2*c*, 2*d*, 2*e*, and 2*f*, as external surfaces of the element body 2. The four lateral surfaces 2*c*, 2*d*, 2*e*, and 2*f* extend in a direction in which the end face 2*a* and the end face 2*b* oppose each other, to connect the pair of end faces 2*a* and 2*b*.

A direction (X direction in the drawings) in which the end face 2*a* and the end face 2*b* oppose each other, a direction (Z direction in the drawings) in which the lateral surface 2*c* and the lateral surface 2*d* oppose each other, and a direction (Y direction in the drawings) in which the lateral surface 2*e* and the lateral surface 2*f* oppose each other are nearly orthogonal to each other. The lateral surface 2*d* is a surface opposing an electronic apparatus (for example, a circuit board or an electronic component) not illustrated in the drawings, when the multilayer coil component 1 is mounted on the electronic apparatus.

The element body 2 is configured by laminating a plurality of magnetic material layers in the Z direction. The plurality of magnetic material layers are made of soft magnetic metal powders. The element body 2 includes a magnetic material portion 11. In the actual element body 2, the plurality of magnetic material layers are integrated to a degree to which inter-layer boundaries cannot be visualized. The magnetic material portion 11 is configured as a connected body of the soft magnetic metal powders. The soft magnetic metal powders are made of a Fe—Si alloy or a Fe—Si—Cr alloy, for example, and oxide films are formed on surfaces of the soft magnetic metal powders. A configuration of the magnetic material portion 11 is described in detail later.

The external electrode 4 is disposed on the end surface 2*a* of the element body 2 and the external electrode 5 is disposed on the end surface 2*b* of the element body 2. That is, the external electrode 4 and the external electrode 5 are separated from each other in the direction in which the end surface 2*a* and the end surface 2*b* oppose each other. Each of the external electrodes 4 and 5 has an approximately rectangular shape in planar view and corners of the external electrodes 4 and 5 are rounded. The external electrodes 4 and 5 include a conductive material (for example, Ag or Pd). The external electrodes 4 and 5 include sintered bodies of conductive paste including conductive metal powder (for example, Ag powder or Pd powder) and glass frit. Electroplating is performed on the external electrodes 4 and 5, and plating layers are formed on surfaces of the external electrodes 4 and 5. When the electroplating is performed, for example, Ni or Sn is used.

The external electrode 4 includes five electrode portions. That is, the external electrode 4 includes an electrode portion 4*a* located on the end surface 2*a*, an electrode portion 4*b* located on the side surface 2*d*, an electrode portion 4*c* located on the side surface 2*c*, an electrode portion 4*d* located on the side surface 2*e*, and an electrode portion 4*e* located on the side surface 2*f*. The electrode portion 4*a* covers an entire surface of the end surface 2*a*. The electrode portion 4*b* covers a part of the side surface 2*d*. The electrode portion 4*c* covers a part of the side surface 2*c*. The electrode portion 4*d* covers a part of the side surface 2*e*. The electrode portion 4*e* covers a part of the side surface 2*f*. The five electrode portions 4*a*, 4*b*, 4*c*, 4*d*, and 4*e* are integrally formed.

The external electrode 5 includes five electrode portions. That is, the external electrode 5 includes an electrode portion 5*a* located on the end surface 2*b*, an electrode portion 5*b* located on the side surface 2*d*, an electrode portion 5*c* located on the side surface 2*c*, an electrode portion 5*d* located on the side surface 2*e*, and an electrode portion 5*e* located on the side surface 2*f*. The electrode portion 5*a* covers an entire surface of the end surface 2*b*. The electrode portion 5*b* covers a part of the side surface 2*d*. The electrode portion 5*c* covers a part of the side surface 2*c*. The electrode portion 5*d* covers a part of the side surface 2*e*. The electrode portion 5*e* covers a part of the side surface 2*f*. The five electrode portions 5*a*, 5*b*, 5*c*, 5*d*, and 5*e* are integrally formed.

The coil 20 includes the plurality of coil conductors 21 to 26 (a plurality of internal conductors) and through-hole conductors 17.

The coil conductors 21 to 26 are separated from each other in the Z direction (first direction) and are adjacent to each other in the Z direction. Distances "d" between the coil conductors 21 to 26 adjacent to each other in the Z direction are the same. The distances "d" are about 20 μm, for example.

Each of the coil conductors 21 to 26 has a width of about 200 μm, for example. One end and another end of each of the coil conductors 21, 23, 25, and 26 are separated from each other in the X direction. One end and another end of each of the coil conductors 22 and 24 are separated from each other in the Y direction. The coil conductors 21 to 26 adjacent to each other in the Z direction include first conductor portions overlapping each other when viewing from the Z direction and second conductor portions not overlapping each other when viewing from the Z direction.

The through-hole conductors 17 are located between the ends of the coil conductors 21 to 26 adjacent to each other in the Z direction. The through-hole conductors 17 connect the ends of the coil conductors 21 to 26 adjacent to each other in the Z direction. The plurality of coil conductors 21 to 26 are electrically connected to each other by the through-hole conductors 17.

An end 21*a* of the coil conductor 21 configures one end E1 of the coil 20. An end 26*b* of the coil conductor 26 configures another end E2 of the coil 20. An axial direction of the coil 20 is a direction along the Z direction. A thickness (height along the Z direction) of the coil 20 is about 80 μm, for example.

The connection conductor 13 is connected to the coil conductor 21. The connection conductor 13 is continuous with the coil conductor 21. The connection conductor 13 is formed integrally with the coil conductor 21. The connection conductor 13 connects the end 21*a* of the coil conductor 21 and the external electrode 4 and is exposed at the end face 2*a* of the element body 2. The connection conductor 13 is connected to the electrode portion 4*a* of the external electrode 4. The connection conductor 13 electrically connects the end E1 of the coil 20 and the external electrode 4.

The connection conductor 14 is connected to the coil conductor 26. The connection conductor 14 is continuous with the coil conductor 26. The connection conductor 14 is formed integrally with the coil conductor 26. The connection conductor 14 connects the end 26*b* of the coil conductor 26 and the external electrode 5 and is exposed at the end face 2*b* of the element body 2. The connection conductor 14 is connected to the electrode portion 5*a* of the external electrode 5. The connection conductor 14 electrically connects the end E2 of the coil 20 and the external electrode 5.

The coil conductors 21 to 26, the through-hole conductors 17, and the connection conductors 13 and 14 include a conductive material (for example, Ag, Pd, Cu, Al, or Ni). The coil conductors 21 to 26, the through-hole conductors 17, and the connection conductors 13 and 14 are configured as sintered bodies of conductive paste including conductive metal powder (for example, Ag powder, Pd powder, Cu powder, Al powder, or Ni powder).

Subsequently, a configuration of the magnetic material portion 11 will be described.

As illustrated in FIGS. 2 and 3, the magnetic material portion 11 includes the low-permeability portions 31 to 35 and a high-permeability portion 40. The low-permeability portions 31 to 35 are located between the coil conductors 21 to 26 adjacent to each other in the Z direction. The low-permeability portions 31 to 35 have frame shapes, for example. The low-permeability portions 31 to 35 extend along the first conductor portions of the coil conductors 21 to 26 when viewing from the Z direction. Also, the low-permeability portions 31 to 35 extend along separation portions between one end and the other ends in the coil conductors 21 to 26.

The high-permeability portion 40 is located in a portion other than the low-permeability portions 31 to 35 in the magnetic material portion 11. The high-permeability portion 40 is formed to surround the coil 20. The high-permeability portion 40 includes a portion (core portion) located at an inner side of the coil 20, a portion located at an outer side of the coil 20, a portion located closer to the lateral surface 2*c* than the coil 20, and a portion located closer to the lateral surface 2*d* than the coil 20.

Figure 4B:
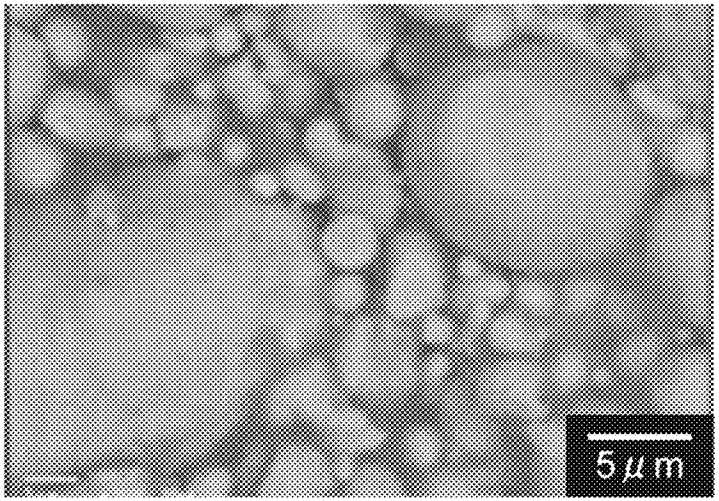
FIGS. 4A and 4B are diagrams illustrating particles of magnetic metal powders included in a magnetic material portion.
Figure 4A:
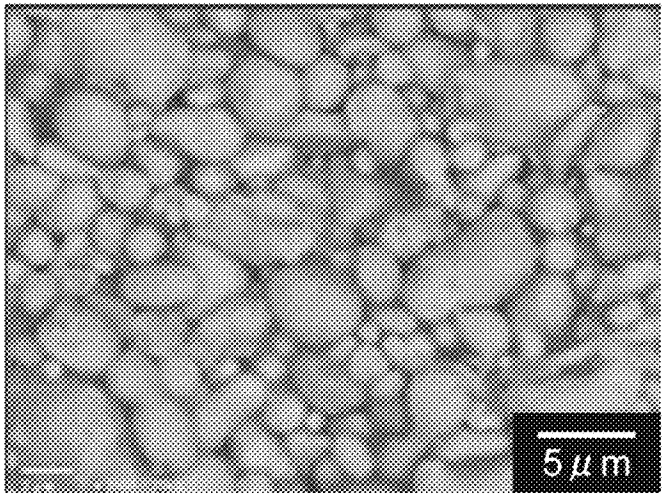

FIGS. 4A and 4B are diagrams illustrating the soft magnetic metal powders included in the magnetic material portion 11. FIG. 4A illustrates the soft magnetic metal powders included in the low-permeability portions 31 to 35. FIG. 4B illustrates the soft magnetic metal powders included in the high-permeability portion 40. As illustrated in FIGS. 4A and 4B, a large amount of soft magnetic metal powders having large particle diameters are included in the high-permeability portion 40, as compared with the low-permeability portions 31 to 35. For example, an average particle diameter of the soft magnetic metal powders included in the low-permeability portions 31 to 35 is about 2 to 6 μm, but an average particle diameter of the soft magnetic metal powders included in the high-permeability portion 40 is about 6 to 20 μm. Therefore, an average particle diameter of the soft magnetic metal powders located at the inner side and the outer side of the coil 20 is larger than an average particle diameter of the soft magnetic metal powders located between the coil conductors 21 to 26 adjacent to each other in the Z direction.

The inner side and the outer side of the coil 20 are respectively an inner side and an outer side of the first conductor portion of each of the coil conductors 21 to 26, when viewing from the Z direction, for example. An "average particle diameter" of the soft magnetic metal powders included in the magnetic material portion 11 is defined by a particle diameter (d50) at an integrated value 50% in a grain size distribution. The "average particle diameter" is acquired in the following way, for example. A scanning electron microscope (SEM) photograph of a cross section of the element body 2 is taken. A cross-section of each of the low-permeability portions 31 to 35 and the high-permeability portion 40 is included in the cross section of the element body 2. The SEM photograph is subjected to image processing by software. By the image processing, boundaries of the soft magnetic metal powders subjected to a heat treatment are determined and areas of the soft magnetic metal powders are calculated. Particle diameters converted into circle equivalent diameters are calculated from the calculated areas of the soft magnetic metal powders. Here, particle diameters of 100 or more soft magnetic metal powers are calculated and a grain size distribution of the soft magnetic metal powders is acquired. A particle diameter (d50) at an integrated value 50% in the acquired grain size distribution is the "average particle diameter". Particle shapes of the soft magnetic metal powders are not limited in particular. On the surfaces of the soft magnetic metal powders subjected to the heat treatment, the oxide films are formed as be described later.

A maximum particle diameter of the soft magnetic metal powders included in the low-permeability portions 31 to 35 is about 15 μm, for example. The maximum particle diameter of the soft magnetic metal powders included in the low-permeability portions 31 to 35 is a maximum particle diameter of the soft magnetic metal powders located between the coil conductors 21 to 26 adjacent to each other in the Z direction. The distance "d" is about 20 μm, for example, as described above. Therefore, the maximum particle diameter of the soft magnetic metal powders located between the coil conductors 21 to 26 adjacent to each other in the Z direction is smaller than the distance "d." The maximum particle diameter of the soft magnetic metal powders located between the coil conductors 21 to 26 adjacent to each other in the Z direction may be a value equal to or smaller than ¾ of the distance "d," for example, a value equal to or smaller than ½ of the distance "d."

Subsequently, processes of manufacturing the multilayer coil component 1 will be described. The multilayer coil component 1 is manufactured as follows, for example. First, a magnetic paste pattern layer becoming the magnetic material portion 11 and a conductive paste pattern layer becoming the coil conductors 21 to 26, the through-hole conductors 17, and the connection conductors 13 and 14 are sequentially laminated by a printing method. By this process, a laminated body is obtained.

The magnetic paste pattern layer is formed by applying magnetic paste and drying the magnetic paste. The magnetic paste includes the soft magnetic metal powders, organic solvents, and organic binders. For example, the magnetic paste is manufactured by mixing the soft magnetic metal powders and organic solvents and organic binders. The soft magnetic metal powders in which an average particle diameter is relatively large are used in the magnetic paste to configure the high-permeability portion 40 and the soft magnetic metal powders in which an average particle diameter is relatively small are used in the magnetic paste to configure the low-permeability portions 31 to 35. The average particle diameter of the soft material metal powders used when each magnetic paste is manufactured is defined by a particle diameter (d50) at an integrated value 50% in a grain size distribution acquired by a laser diffraction scattering method.

The conductive paste pattern layer is formed by applying conductive paste and drying the conductive paste. The conductive paste includes the conductive metal powders, organic solvents, and organic binders. For example, the conductive paste is manufactured by mixing the conductive metal powders and organic solvents and organic binders.

Next, the laminated body is cut in a size of each multilayer coil component 1. By this process, a green chip is obtained. Next, the obtained green chip is subjected to barrel polishing. By this process, the green chip in which a corner portion or a ridge portion is rounded is obtained. Next, the green chip subjected to the barrel polishing is subjected to the heat treatment under predetermined conditions. By the heat treatment, surfaces of the soft magnetic metal powders of the magnetic paste pattern layer and surrounding portions thereof are oxidized and the oxide films are formed on the surfaces. The oxide films formed on the surfaces of the soft magnetic metal powders are coupled to each other, so that the magnetic material portion 11 is configured as the coupled body of the soft magnetic metal powders. By the heat treatment, the green chip becomes the element body 2. By the heat treatment, the coil conductors 21 to 26, the through-hole conductors 17, and the connection conductors 13 and 14 are configured as the sintered bodies of the conductive paste. That is, an intermediate body including the element body 2 in which the coil 20 is disposed is obtained. The particle diameters of the soft magnetic metal powders do not change substantially before and after the heat treatment.

Next, the conductive paste for the external electrodes 4 and 5 is applied to the external surface of the element body 2 and the conductive paste is subjected to the heat treatment under the predetermined conditions. By this process, the external electrodes 4 and 5 are formed in the element body 2. Then, the plating is performed on the surfaces of the external electrodes 4 and 5. By the above processes, the multilayer coil component 1 is obtained.

As described above, in the first embodiment, the soft magnetic metal powders having the small average particle diameter are located between the coil conductors 21 to 26 adjacent to each other in the Z direction and the soft magnetic metal powders having the large average particle diameter are located at the inner side of the coil 20 when viewing from the Z direction. Therefore, in the multilayer coil component 1, permeability of the entire element body 2 is high as compared with a multilayer coil component in which the soft magnetic metal powders having the small average particle diameter are located over the whole of the magnetic material layers located between the coil conductors adjacent to each other. Because the average particle diameter of the soft magnetic metal powders located between the coil conductors 21 to 26 adjacent to each other in the Z direction is small, permeability between the coil conductors 21 to 26 is low. Therefore, from a relation in which a resistance component at a high frequency side decreases when the permeability is low, an action to reduce loss at the high frequency side is provided between the coil conductors 21 to 26 adjacent to each other in the Z direction. At the high frequency side, a magnetic path is formed around the coil conductors 21 to 26, so that the action between the coil conductors 21 to 26 adjacent to each other in the Z direction is effectively provided. As a result, in the multilayer coil component 1, even when the permeability of the element body 2 is increased, the loss at the high frequency side is reduced.

In the multilayer coil component 1, the average particle diameter of the soft magnetic metal powders located at the outer side of the coil 20 when viewing from the Z direction is also smaller than the average particle diameter of the soft magnetic metal powders located between the coil conductors 21 to 26 adjacent to each other in the Z direction. Therefore, the permeability of the entire element body 2 is further increased.

In the multilayer coil component 1, the maximum particle diameter of the soft magnetic metal powders located between the coil conductors 21 to 26 adjacent to each other in the Z direction is smaller than the distance "d." For this reason, the coil conductors 21 to 26 adjacent to each other in the Z direction is rarely connected electrically by the soft magnetic metal powders located between the coil conductors 21 to 26. As a result, short-circuiting of the coil conductors 21 to 26 is suppressed.

Second Embodiment

Figure 5:
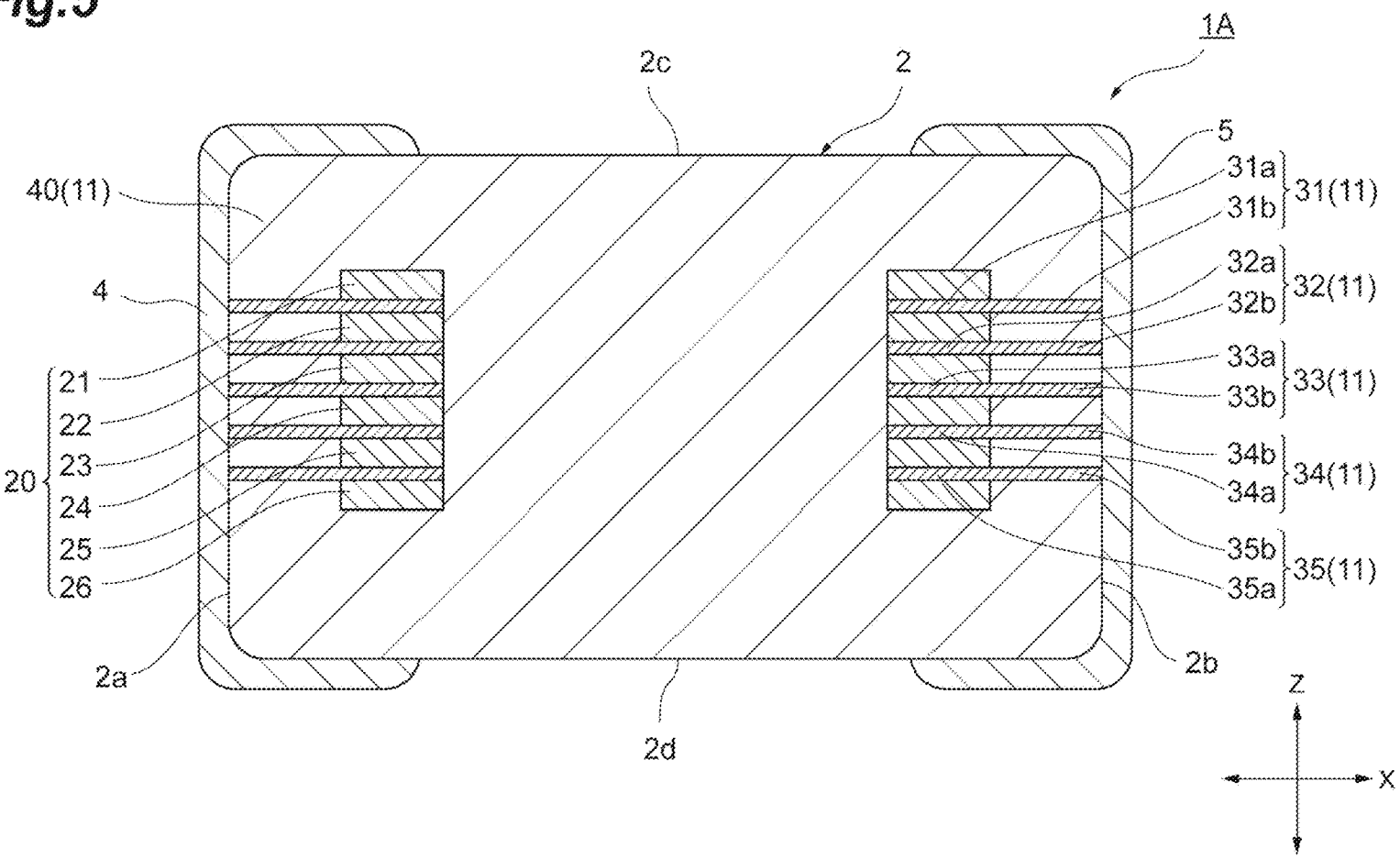
FIG. 5 is a cross-sectional view of a multilayer coil component according to a second embodiment.

Subsequently, a multilayer coil component 1A according to a second embodiment will be described with reference to FIG. 5. FIG. 5 is a cross-sectional view of the multilayer coil component according to the second embodiment. Similar to the multilayer coil component 1, the multilayer coil component 1A includes an element body 2, a pair of external electrodes 4 and 5, a coil 20, and connection conductors 13 and 14 (not illustrated in FIG. 5).

FIG. 5 is a cross-sectional view corresponding to FIG. 3. As illustrated in FIG. 5, the multilayer coil component 1A is different from the multilayer coil component 1 in a range in which low-permeability portions 31 to 35 in a magnetic material portion 11 are located. The low-permeability portions 31 to 35 are located at an outer side of the coil 20 when viewing from a Z direction, in addition to portions between coil conductors 21 to 26 adjacent to each other in the Z direction.

The low-permeability portion 31 includes a first portion 31*a* and a second portion 31*b*. The first portion 31*a* is located between the coil conductor 21 and the coil conductor 22. The second portion 31*b* is located at the outer side of the coil 20 when viewing from the Z direction. The low-permeability portion 32 includes a first portion 32*a* and a second portion 32*b*. The first portion 32*a* is located between the coil conductor 22 and the coil conductor 23. The second portion 32*b* is located at the outer side of the coil 20 when viewing from the Z direction. The low-permeability portion 33 includes a first portion 33*a* and a second portion 33*b*. The first portion 33*a* is located between the coil conductor 23 and the coil conductor 24. The second portion 33*b* is located at the outer side of the coil 20 when viewing from the Z direction. The low-permeability portion 34 includes a first portion 34*a* and a second portion 34*b*. The first portion 34*a* is located between the coil conductor 24 and the coil conductor 25. The second portion 34*b* is located at the outer side of the coil 20 when viewing from the Z direction. The low-permeability portion 35 includes a first portion 35*a* and a second portion 35*b*. The first portion 35*a* is located between the coil conductor 25 and the coil conductor 26. The second portion 35*b* is located at the outer side of the coil 20 when viewing from the Z direction.

The first portions 31*a* to 35*a* extend along the first conductor portions of the coil conductors 21 to 26, when viewing from the Z direction. The first portions 31*a* to 35*a* also extend along separation portions between one end and the other ends in the coil conductors 21 to 26. The second portions 31*b* to 35*b* are formed integrally with the first portions 31*a* to 35*a*. The second portions 31*b* to 35*b* extend in an outside direction of the coil 20 and are exposed at end faces 2*a* and 2*b* and lateral surfaces 2*e* and 2*f* of the element body 2.

Even in the multilayer coil component 1A, because soft magnetic metal powders having a large average particle diameter are located at an inner side of the coil 20 when viewing from the Z direction, permeability of the entire element body 2 is high. In addition, because an average particle diameter of soft magnetic metal powders between the coil conductors 21 to 26 adjacent to each other in the Z direction is small, permeability between the coil conductors 21 to 26 is low. Therefore, an action to reduce loss at a high frequency side is effectively provided between the coil conductors 21 to 26 adjacent to each other in the Z direction. As a result, even in the multilayer coil component 1A, even when the permeability of the element body 2 is increased, the loss at the high frequency side is reduced.

The various embodiments have been described. However, the present invention is not limited to the embodiments and various changes, modifications, and applications can be made without departing from the gist of the present invention.

Figure 6:
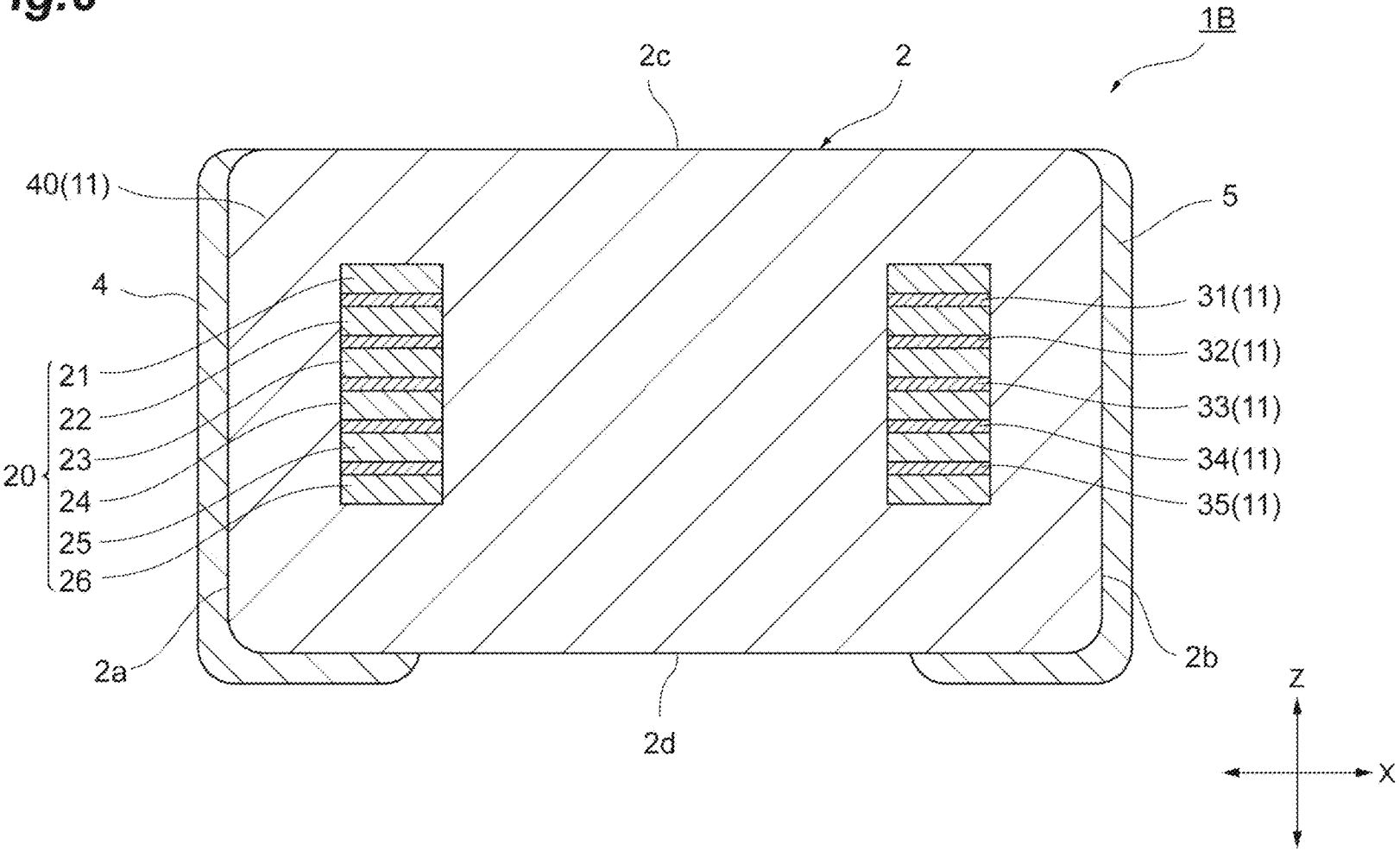
FIG. 6 is a cross-sectional view of a multilayer coil component according to a modification.
Figure 7:
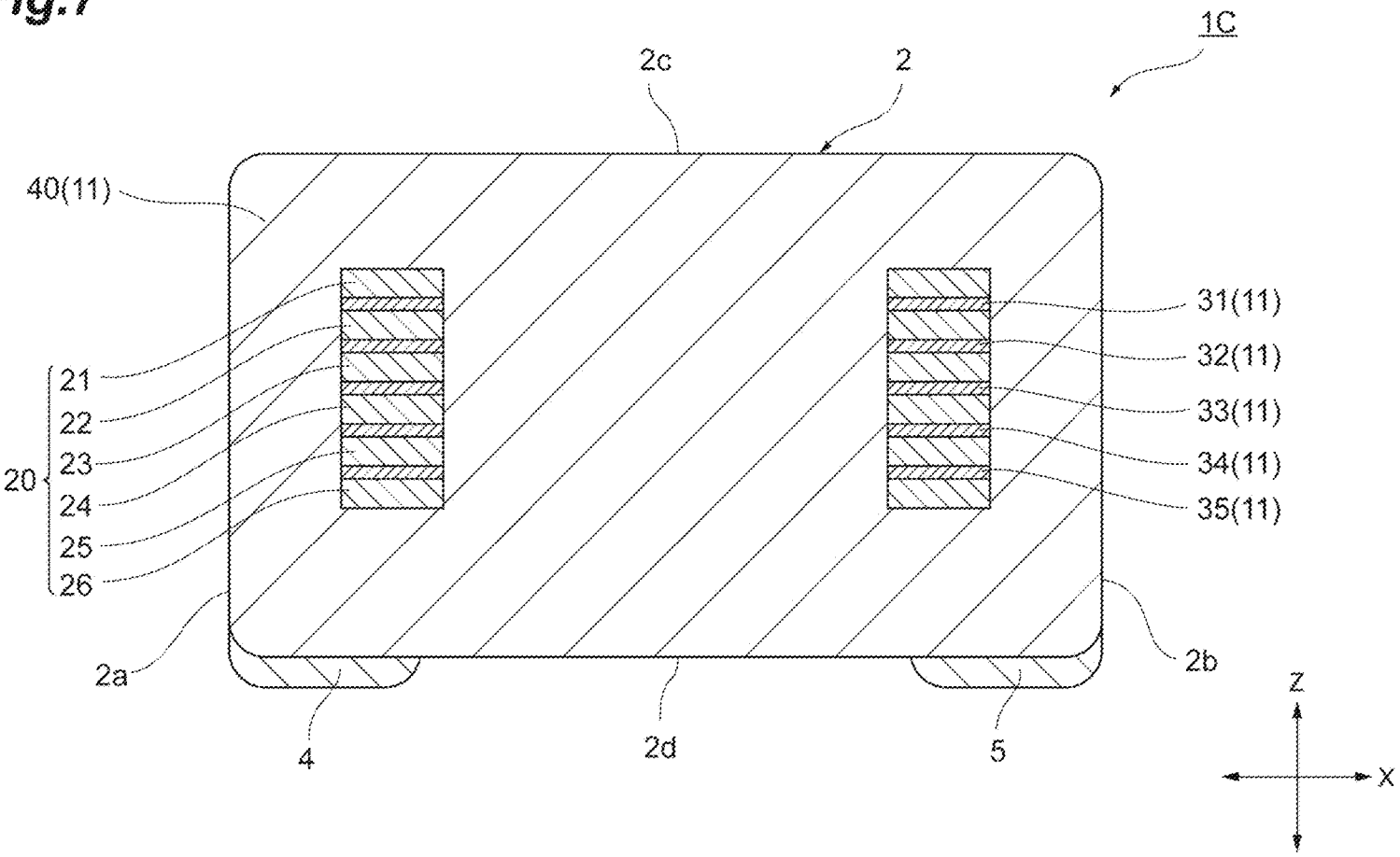
FIG. 7 is a cross-sectional view of a multilayer coil component according to a modification.

Configurations of multilayer coil components 1B and 1C according to modifications of the embodiments will be described on the basis of FIGS. 6 and 7. FIGS. 6 and 7 illustrate cross-sectional views of the multilayer coil components according to the modifications. As illustrated in FIG. 6, the external electrode 4 may not include the electrode portion 4*c*, 4*d*, and 4*e* and the external electrode 5 may not include the electrode portion 5*c*, 5*d*, and 5*e*. That is, the external electrodes 4 and 5 may have cross-sectional shapes of approximately L shapes. As illustrated in FIG. 7, the external electrodes 4 and 5 may be disposed on only the lateral surface 2*d*.

The low-permeability portions 31 to 35 are not necessarily located between the coil conductors 21 to 26 adjacent to each other in the Z direction. For example, the low-permeability portions 31 to 35 may be located closer to the lateral surface 2*c* than the coil conductor 21. The low-permeability portions 31 to 35 may be located closer to the lateral surface 2*d* than the coil conductor 26.

The number of each of coil conductors and low-permeability portions included in the element body 2 is not limited to the embodiments. At least one low-permeability portion may be included in the element body 2. That is, an average particle diameter of the soft magnetic metal powders located only between the two coil conductors adjacent to each other in the Z direction among the plurality of coil conductors 21 to 26 adjacent to each other in the Z direction, not between the coil conductors 21 to 26, may be larger than an average particle diameter of the soft magnetic metal powders located at the inner side of the coil 20 when viewing from the Z direction.

A maximum particle diameter of the soft magnetic metal powders located between the coil conductors 21 to 26 adjacent to each other in the Z direction may be equal to or larger than the distance "d." The distance "d" may not be the same between the coil conductors 21 to 26 adjacent to each other in the Z direction and may be different between the coil conductors 21 to 26.

The low-permeability portions 31 to 35 have the frame shapes. However, the present invention is not limited thereto. For example, the low-permeability portions 31 to 35 may have shapes in which parts are cut. The low-permeability portions 31 to 35 may not overlap the separation portions between one end and the other ends in the coil conductors 21 to 26 when viewing from the Z direction.

What is claimed is:

1. A multilayer coil component comprising:

an element body including a low-permeability portion and a high-permeability portion that include soft magnetic metal powders; and a coil disposed in the element body, wherein the coil includes a plurality of internal conductors electrically connected to each other, the plurality of internal conductors being separated from each other in a first direction and adjacent to each other in the first direction, an average particle diameter of the soft magnetic metal powders included in the high-permeability portion is larger than an average particle diameter of the soft magnetic metal powders included in the low-permeability portion, the high-permeability portion is located at an inner side of the coil when viewed from the first direction, and the low-permeability portion is located between the internal conductors adjacent to each other in the first direction, and is not located at the inner side of the coil when viewed from the first direction.

2. The multilayer coil component according to claim 1, wherein the high-permeability portion is located at an outer side of the coil when viewed from the first direction.

3. The multilayer coil component according to claim 1, wherein a maximum particle diameter of the soft magnetic metal powders included in the low-permeability portion located between the internal conductors adjacent to each other in the first direction is smaller than a distance between the internal conductors adjacent to each other in the first direction.

* * * * *